United States Patent [19]

Schupphaus et al.

[11] Patent Number: 4,483,568

[45] Date of Patent: Nov. 20, 1984

[54] ADVANCING APPARATUS FOR A MULTI-UNIT MINING MACHINE

[75] Inventors: Herbert Schupphaus, Bochum; Heinz Pulger, Dortmund, both of Fed. Rep. of Germany

[73] Assignee: Gebr. Eickhoff Maschinefabrik und Eisengiesserei m.b.H., Bochum, Fed. Rep. of Germany

[21] Appl. No.: 416,929

[22] Filed: Sep. 13, 1982

[30] Foreign Application Priority Data

Sep. 22, 1981 [DE] Fed. Rep. of Germany ..... 3137553

[51] Int. Cl.[3] ..... E21C 29/22

[52] U.S. Cl. ..... 299/53; 299/46

[58] Field of Search ..... 299/42, 43, 53, 54; 105/29 R, 29 TL; 74/422

[56] References Cited

U.S. PATENT DOCUMENTS

| | | | |
|---|---|---|---|
| 595,156 | 12/1897 | Fairchild | 105/29 R |
| 991,954 | 5/1911 | Charbonneau | 105/29 R |
| 1,027,075 | 5/1912 | Sessions | 105/29 R |
| 3,922,970 | 12/1975 | Glastra | 105/29 R |
| 4,189,188 | 2/1980 | Schupphaus | 299/53 |

FOREIGN PATENT DOCUMENTS

| | | | |
|---|---|---|---|
| 2547196 | 5/1977 | Fed. Rep. of Germany | 299/42 |
| 501159 | 4/1976 | U.S.S.R. | 299/42 |

*Primary Examiner*—George A. Suchfield
*Assistant Examiner*—Michael Starinsky
*Attorney, Agent, or Firm*—Thomas H. Murray; Clifford A. Poff

[57] ABSTRACT

Apparatus to advance a multi-unit mining machine along a face conveyor in an underground mine includes a hydraulic unit with an advancing mechanism that extends around a toothed rack. The rack extends over the length of machine movement. The hydraulic unit is an independent unit on a machine body of the mining machine and is used for increasing the advancing force provided by other existing advancing units for the mining machine. The hydraulic unit is narrower than the other units on the machine body and is attached by vertical flanges to adjacent units on the machine body. The hydraulic unit receives a winch casing between oppositely-disposed flanges for guided vertical movement of the casing. The casing has pins extending in the direction of machine movement from opposite top portions thereof to engage with members that slide vertically between guide bars on the flanges for vertical mobility. Clearances between the parts provide limited horizontal mobility.

7 Claims, 6 Drawing Figures

ADVANCING APPARATUS FOR A MULTI-UNIT MINING MACHINE

BACKGROUND OF THE INVENTION

This invention relates to an apparatus for advancing a mining machine comprised of a multiplicity of units for use in an underground mine. More particularly, the present invention relates to such an apparatus wherein a unit of the mining machine comprises a hydraulic unit with a pump and reservoir connected by flexible hoses to a number of hydraulic motors for driving common reduction gearing connected to a toothed drive wheel that is, in turn, engaged with a rack extending in the direction of movement for the mining machine. The hydraulic motors, reduction gearing and toothed drive wheel being received in a winch casing that extends around the toothed rack.

As disclosed in U.S. application Ser. No. 366,151, filed Apr. 7, 1982, now U.S. Pat. No. 4,451,090, drive mechanisms on a mining machine are guided along a toothed rack extending lengthwise of the direction of movement for the mining machine. Each drive mechanism includes at least one drive wheel to engage the teeth of the rack and a hydraulic motor connected to the drive wheel either directly or by way of a transmission. A hydraulic pump on the mining machine is connected by supply lines for hydraulic fluid to the hydraulic motor. The drive wheel, the hydraulic motor or a plurality of hydraulic motors, if used, and possibly the pump and drive motor therefor are disposed on their own carriage or slide which bears on and is guided on the rack. The carriage or slide forms an advancing unit which is separate from the mining machine and extends below at least parts of the rack to insure satisfactory engagement between the drive wheel and the rack. One or more rack-mounted advancing units is disposed between runners on the same side of the mining machine or instead of runners, only advancing units are connected to the body of the mining machine, i.e., to its frame, and serve as runners. Other advancing units situated between these advancing units or runners bear only on the advancing units or runners situated in front thereof in the direction of machine travel. The advancing units which are connected to the runners on the machine are also connected to the adjacent advancing unit or units. This construction and arrangement enables the advancing units to be fitted to a mining machine which is already in use or to provide a mining machine during the actual assembly with the necessary drive power for mining operations at a particular place where the machine is to be used. The advancing mechanisms of this type have the advantage that they can be adapted accurately to the run of the rack even when the advancing unit is not serving as runners or disposed very near a mechanism which serves as a runner. Engagement between a drive wheel and the rack is, therefore, always insured. Consequently, the advancing mechanism can transmit full driving power to the rack for moving the mining machine with the required power at the intended mining site.

SUMMARY OF THE INVENTION

It is an object of the present invention to provide apparatus for advancing a mining machine which can be disposed substantially within the cross section of the body of the mining machine but without limiting the mobility of the apparatus relative to the machine body.

More particularly, according to the present invention, there is provided an apparatus for advancing a mining machine along a toothed rack extending in the direction of movement for the mining machine in an underground mine. The mining machine being comprised of a plurality of units which includes a hydraulic unit independent of a machine body, the hydraulic unit being narrower than the other units and includes a pump and a reservoir therefor connected by flexible hoses to a plurality of drive motors, the apparatus in combination therewith includes two vertical flanges on opposite side walls of the hydraulic unit adjacent the toothed rack but within the cross section of the machine body, a gear drive wheel coupled to reduction gearing driven by a plurality of the drive motors, the gear drive wheel being engaged with the toothed rack, a winch casing received between the two vertical flanges and extending around the toothed rack for receiving said gear drive wheel, reduction gearing and drive motors thereof, and means for guiding the winch casing for vertical movement between the vertical flanges.

Thus, the apparatus of the present invention provides a hydraulic unit which is an independent unit and narrower than other units on a machine body. The hydraulic unit is provided with two vertical flanges on opposite side walls adjacent a toothed rack and disposed within the cross section of the machine body. A winch casing is guided for vertical movement between these flanges. This construction and relationship of parts provide that the winch casing and hydraulic unit can be received subsequently in the body of a mining machine; adapted to the cross section of the machine body and arranged such that the hydraulic unit and the winch casing are disposed very close together. In this manner, the lines between the hydraulic unit and the winch casing are very short and unlikely to experience disturbances. Moreover, the winch casing can move vertically with sufficient freedom to insure a satisfactory meshing relation between the rack teeth and the drive gear while the casing parts below the rack vertically guide the winch casing as the mining machine moves.

According to another feature of the present invention, the two flanges of the hydraulic unit can be connected to the adjacent units on the machine body with the proximal sides of the flanges each having a vertical guide in the form of a guide bar, rail or the like. The winch casing positively engages these vertical guides by way of corresponding projections. Guide bars at opposite sides of the flanges are rigidly connected by fasteners to the adjacent machine units to provide freedom for vertical movement by the winch casing and by way of the projections, provide a connection between the machine body and the winch casing.

It is advantageous to provide that the winch casing bears on and is guided along the rack and that the winch casing contacts an abutment at either side thereof immediately above the rack depending, of course, upon whichever end face of the casing is toward the front of the mining machine in relation to the direction of machine movement. The driving force produced by the advancing apparatus is transferred at the place where a tooth flank of the drive wheel contacts the rack and, therefore, the force is transmitted very near its place of origin, i.e., directly above the rack and with a very short force lever arm formed with the machine frame of the mining machine.

It is convenient to provide pins extending in the direction of machine movement for contact with the winch casing to accommodate movements in all directions. The pins have shaped projections to engage in the guide bars with clearances or clearances extending about the pin. This construction eliminates strain between the winch casing and the casing retaining guide bars of the two flanges when the casing is inclined relative to the mining machine due to movement over bumps or depressions while guided on the rack.

Another feature of the present invention provides that the hydraulic unit includes an intermediate shaft that extends lengthwise of the machine body while coupled to a driving motor on the machine body and coupled to a journal for a machine head that carries the mining tool for transmitting torque to the latter. It is convenient in this instance to drivingly connect the intermediate shaft to the pump of the hydraulic unit to obviate the need for an additional drive motor for the pump.

These features and advantages of the present invention as well as others will be more fully understood when the following description is read in light of the accompanying drawings, in which.

Figure 1:
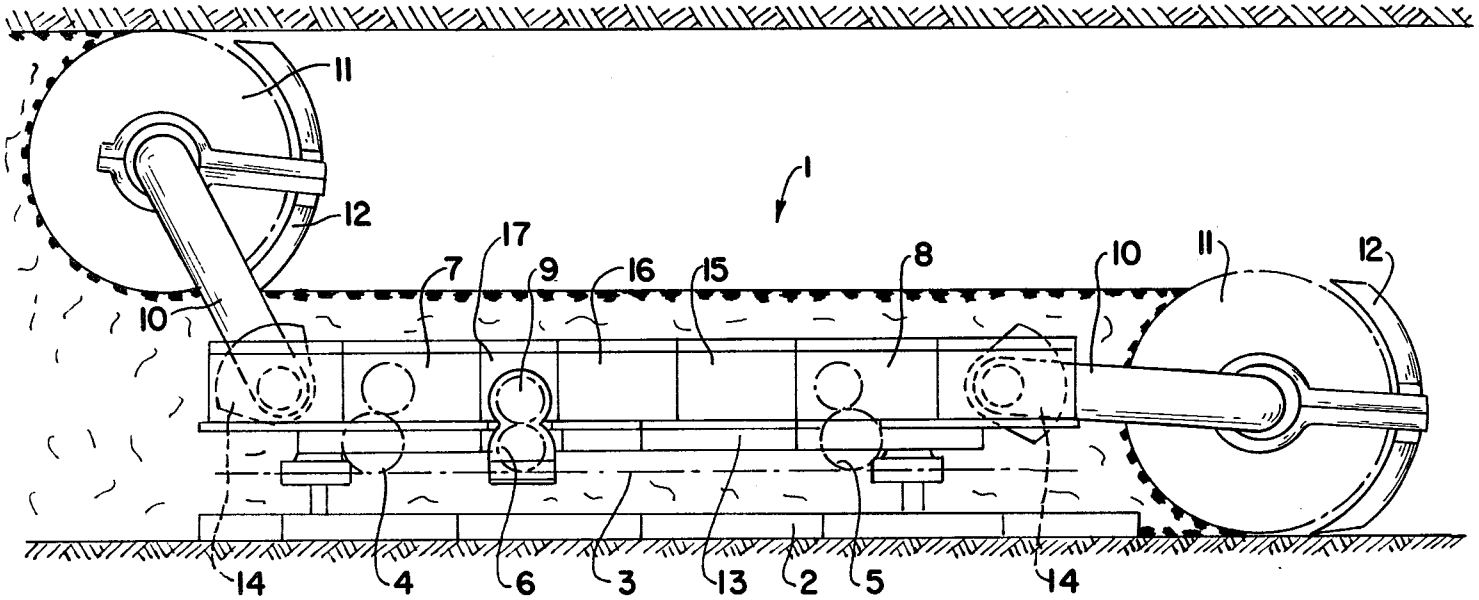
FIG. 1 is a side elevational view of a coal mining machine embodying the features of the present invention.
Figure 2:
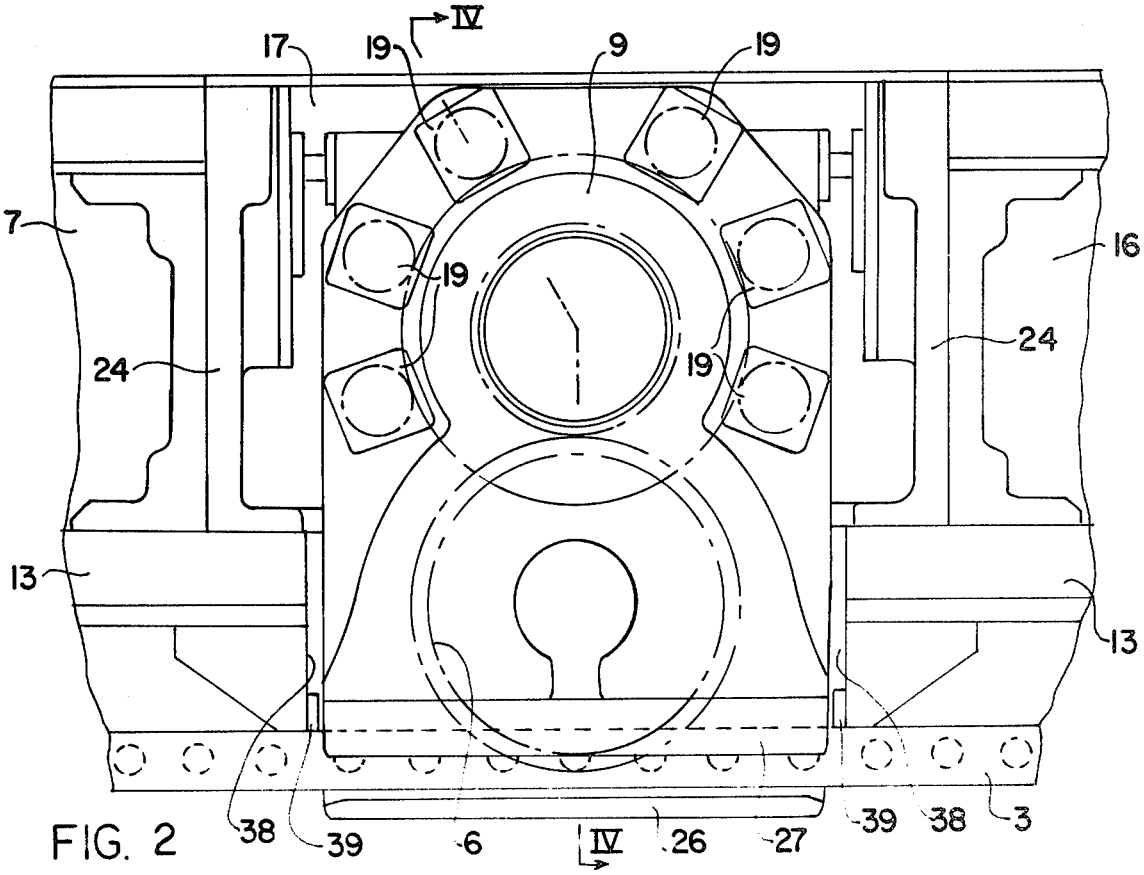
FIG. 2 is an enlarged side view illustrating details of the apparatus for advancing the mining machine according to the present invention.

As shown in FIG. 1, a mining machine 1, sometimes referred to as a winning machine, is disposed above a face conveyor 2 that includes a face ramp at the face side of the conveyor on which roller runners, not shown, of the mining machine contact for movement therealong. On the stow side or machine side of the face conveyor, there is a multi-sectioned toothed rack 3 that is engaged by driving wheels 4, 5 and 6 of advancing mechanisms 7, 8 and 9, respectively, for advancing the mining machine along the face conveyor. Support arms 10 pivot on the machine body about horizontal axes extending transverse to the direction of machine movement. Each support arm is associated with a shearer drum 11 that rotates about an axis to release coal by contact with a mine face. Outwardly spaced from each shearer drum is the usual clearing plate 12. Actuating cylinders, not shown, are disposed near the face side below the machine 1 where they are mounted within a machine frame 13 for pivoting arms 10 about the horizontal pivot axes. In the embodiment of the mining machine shown in FIG. 1, the body of the mining machine comprises seven units, namely two machine casings 14 disposed one at each end of the machine body; advancing units 7 and 8; a shearer motor 15; a unit 16 to house electrical control elements for the mining machine and the hydraulic system to operate the actuating cylinders for adjusting the arms 10 as well as control elements for the hydraulic system and the hydraulic pressure-producing facilities; and lastly, a hydraulic unit 17. Unit 17 includes, as shown in FIG. 2, a fluid supply unit 18 comprised of one or more hydraulic pumps and the usual hydraulic fluid reservoir therefor. A plurality of hydraulic motors 19 of the advancing apparatus 9 are connected by parallel fluid supply lines to the supply unit 18. The plurality of hydraulic motors 19 consists of six motors arranged as shown in FIG. 2.

Figure 3:
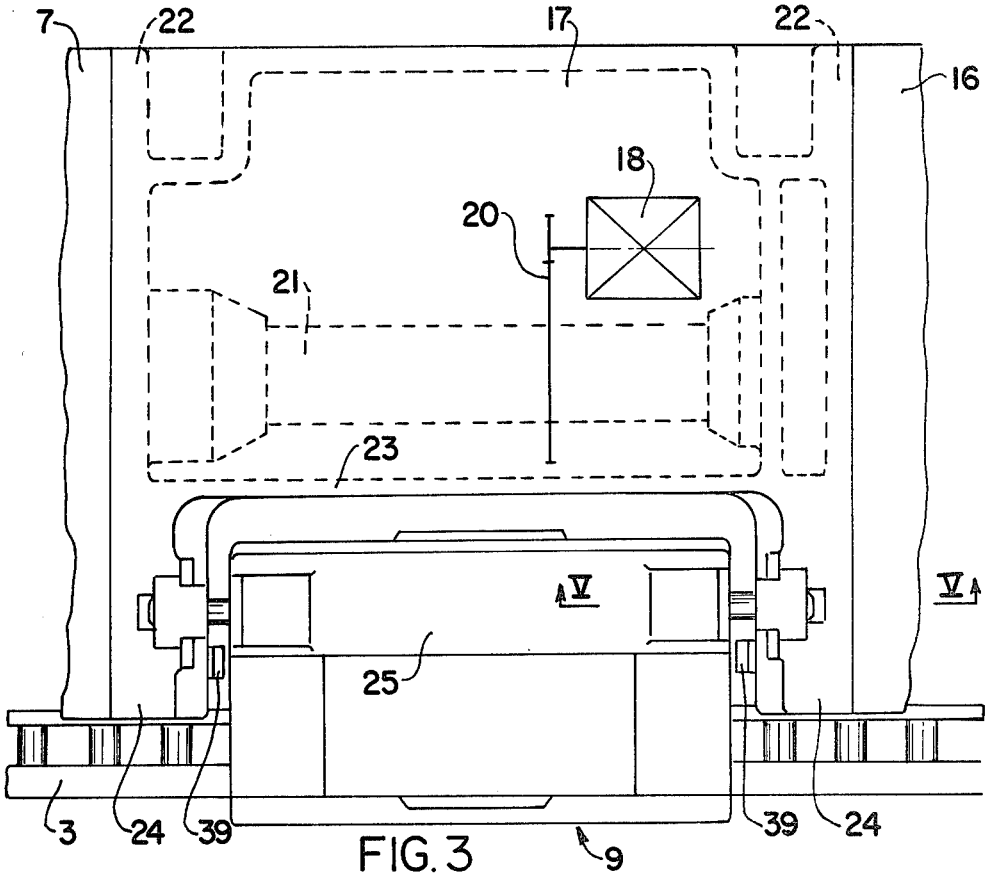
FIG. 3 is a plan view of the apparatus shown in FIG. 2 without a cover plate.

As shown in FIG. 3, the pump of the supply unit 18 is driven by a gear 20 coupled to an intermediate shaft 21 of the hydraulic unit 17. Shaft 21 extends lengthwise of the hydraulic unit and is coupled at one end by coupling gears, not shown, with the output shaft of the mining machine drive motor 15. The other end of the shaft 21 is coupled by coupling gears, not shown, with a drive input shaft in casing 14 for rotating the mining tool. As shown in FIG. 3, the hydraulic unit 17, which is an independent unit, is narrower than units 7 and 16 adjacent thereto while carried on the machine body. Flanges 22 at opposite vertical sides of unit 17 are secured by threaded fasteners to the adjacent units 7 and 16 whereby the unit 17 can be readily replaced at any time in the event repairs become necessary. A side wall 23 of the hydraulic unit is disposed inwardly along the machine body from the rack 3 and includes two opposed-vertical flanges 24 within the cross section of the machine body. The flanges 24 also connect the hydraulic unit to the units 7 and 16 adjacent thereto. A winch casing 25 of the advancing mechanism 9 is disposed between and guided for vertical movement on the flanges 24. The vertical mobility provided by this relationship of parts is necessary together with a smaller amount of horizontal mobility to permit the casing 25 for the advancing mechanism 9 to follow the run of the rack which will be apparent to those skilled in the art from FIG. 4.

Figure 5:
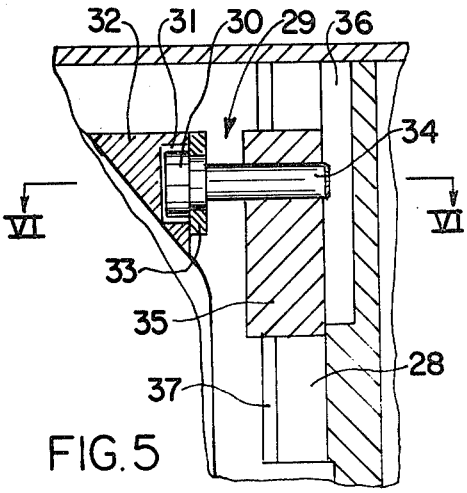
FIG. 5 is a partial sectional view taken along line V—V of FIG. 3.
Figure 6:
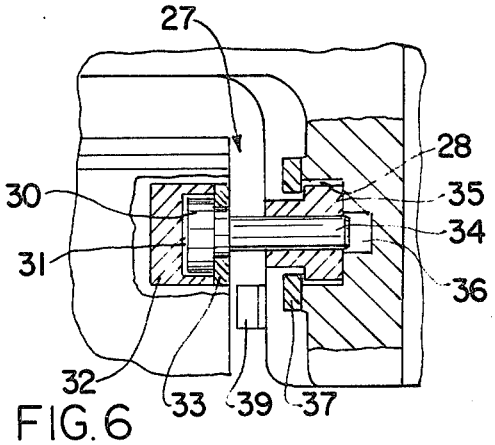
FIG. 6 is a partial sectional view taken along line VI—VI of FIG. 5.

As shown in FIGS. 5 and 6, vertical guide bars 28 are formed in spaced-apart relation on each of the flanges 24 of the hydraulic unit 17 to enable mobility of at least the drive unit of hydraulic unit 17. On opposite sides of the casing 25 at the top portion thereof, two shouldered pins or the like 29 extend opposite one another as considered in relation to their length. Each pin has a head 30 that can move in all directions in a recess 31 formed in a projection 32 from the casing 25. A disc 33 is attached by fasteners to the projection 32 for retaining the head 30 of each pin in the recess. Each pin has an elongated cylindrical shank or stem or the like 34 that extends into engagement with a dovetailed guide block or projection 35 which is disposed between the guide bars 28 on a flange 24. This same construction is provided for each of the flanges 24 of hydraulic unit 17 for mobility in all directions. A vertical groove 36 is formed internally between the bars 28 to receive an end portion of a pin 29 for limited longitudinal movement thereof when the winch casing 25 pivots about the axis of drive wheel 6. The guide block or projection 35 is retained between the guide bars 28 by means of strips 37 attached by fasteners to the flange 24.

As shown in FIGS. 2, 3 and 6, the winch casing 25 has end face surfaces 38 at opposite sides thereof, either of which surfaces can engage with an abutment 39 on the machine frame 13 depending upon which end face 38 forms a front or leading face in relation to the direction of travel by the mining machine. The two abutments 39 are disposed immediately above the rack 3 and thus transmit with very short lever arms the advancing force produced by the advancing mechanism 9 to the frame 13 of the mining machine. The distance between the abutments 39 is such that the winch casing 25 disposed therebetween can adjustably move relative to the machine body or rack 3 to accommodate necessary movements as the machine traverses over bumps or depressions.

Figure 4:
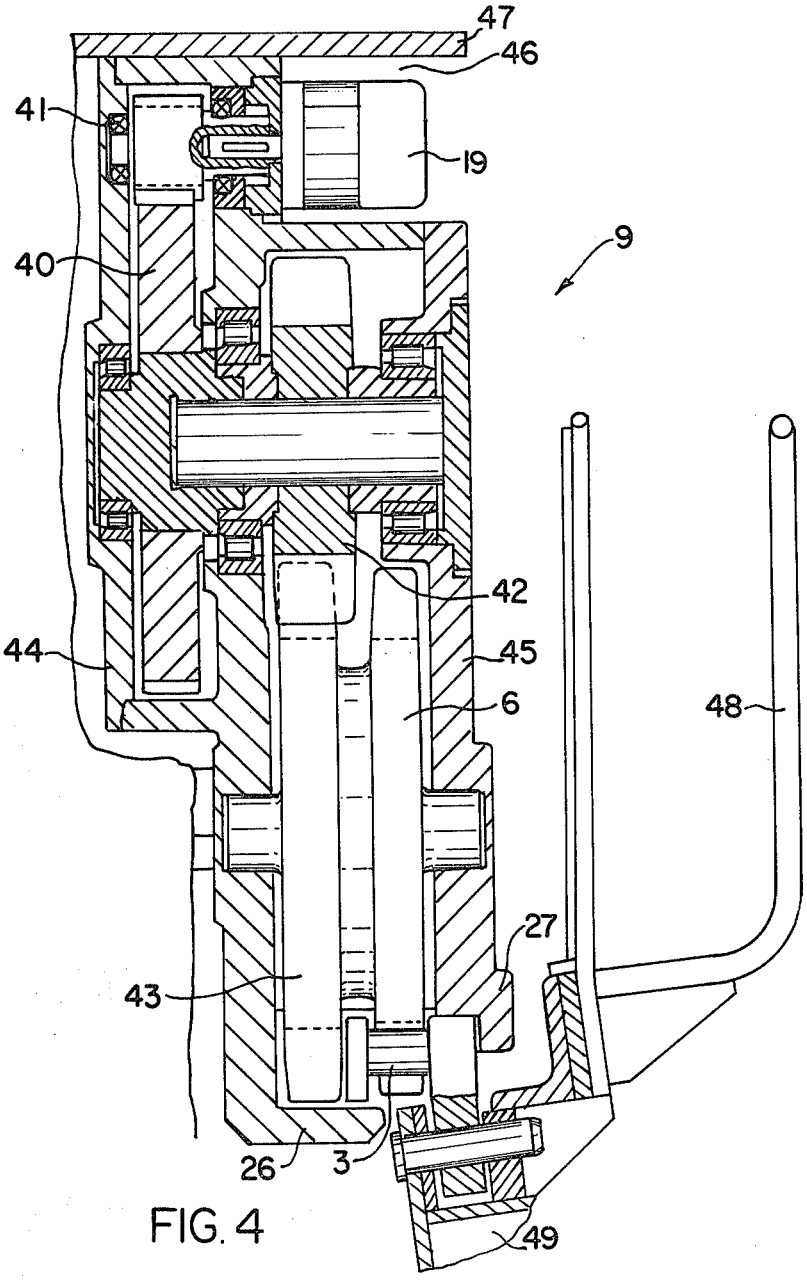
FIG. 4 is a sectional view taken along line IV—IV of FIG. 2.

As shown in FIG. 4, the driving force of advancing mechanism 9 is produced by preferably arranging six hydraulic motors 19 at spaced-apart locations about a gear 40 such that the rotational axis of each motor is perpendicular to the direction of movement by the mining machine. A pinion 41 on the output shaft of each motor meshes with gear 40 to form a driving connection therebetween. A shaft on which gear 40 is mounted also carries a gear 42 for transmitting the rotary motion to a gear 43, the latter being rigidly connected to a drive wheel 6 having teeth that mesh with the teeth of rack 3. Bearing plates 44 and 45 are releasably attached to the winch casing 25 to facilitate assembly of the components of the advancing mechanism 9. Motors 19 are disposed in recesses 46 in the winch casing so as to be readily replaceable at any time. A cover plate 47 on the winch casing protects motors 19 against falling rock or debris from the roof of the mine. The winch casing is provided with means to engage the underside of rack 3. As shown in FIGS. 2 and 4, such means takes the form of a skid runner 26 on a horizontal extension from the winch casing. The skid runner extends outwardly from the winch casing a sufficient distance to engage with the underside of an inwardly-situated rail part of the rack. An outwardly-situated rail part of the rack is connected by pin members to face accessories 49 of a side bracket 48. The top surface of the outward rail portion of rack 3 can slideably engage with a downwardly-facing guide surface on arm section 27 extending from cover plate 45. Members 26 and 27 move along opposite sides of the rack 3 in a manner to maintain proper meshing relation between the teeth of drive wheel 6 and the rack.

The present invention provides that the motors 19 receive pressurized hydraulic fluid from hydraulic lines, not shown, that extend from the motors to the hydraulic unit 17. The advancing units 7 and 8 and the unit 9 are driven independently of one another so that the drive wheels 4, 5 and 6 of each of these units are equally loaded when the mining machine 1 is advanced along the face conveyor. Electric and cooling fluid supplies are provided for the various units of the mining machine by way of power and hydraulic lines disposed inside bracket 48 and extending to the mining machine throughout its movement on the face conveyor. The brackets 48 are connected to the face accessories 49 which preferably support discrete and interchangeable portions of the rack 3.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. An apparatus for advancing a mining machine along a toothed rack extending in the direction of movement by the mining machine in an under ground mine, said mining machine being comprised of a plurality of units which includes a hydraulic unit independent of a machine body, said hydraulic unit being narrower than the other units and including a pump and reservoir therefor connected by flexible hoses to a plurality of drive motors, said apparatus including in combination therewith:

two vertical flanges each being on one of opposite side walls of said hydraulic unit adjacent said toothed rack but within the cross section of said machine body and connected to two of said units which are at opposite sides of said hydraulic unit, a gear drive wheel coupled to reduction gearing driven by a plurality of said drive motors, said gear drive wheel being engaged with said toothed rack, a winch casing received between said flanges and extending around said toothed rack for receiving said gear drive wheel, reduction gearing and drive motors thereof, and means for guiding said winch casing for vertical movement between said vertical flanges.

2. The combination according to claim 1 wherein said means for guiding includes vertical guide members at proximal sides of said winch casing engaged with interfitting projections on the winch casing.

3. The combination according to claim 2 wherein said vertical guide members interfit with said projections only at the top of said winch casing above said toothed rack.

4. The combination according to claim 1, 2 or 3 wherein said winch casing includes guide surfaces to bear on said toothed rack, and wherein the combination further includes abutments on said machine body at opposite sides of said winch casing immediately above said toothed rack for contact with a side of said winch casing as established by the direction of movement by the mining machine along said toothed rack.

5. The combination according to claim 1 wherein said means for guiding includes pins extending to connect with said winch casing in the direction of movement by the mining machine along said toothed rack, guide surfaces carried by said vertical flanges, and members interconnecting said pins and said guide surfaces with clearances for movement of the pins in all directions.

6. The combination according to claim 1 further including a machine head carrying a mining tool, said plurality of units including a drive unit having a drive motor coupled to said machine head by an intermediate shaft extending lengthwise of said machine body in said hydraulic unit for transmitting power to said hydraulic unit.

7. The combination according to claim 6 further comprising means for drivingly connecting said intermediate shaft to said pump of the hydraulic unit.

* * * * *